US010815748B1

(12) United States Patent
Meeks et al.

(10) Patent No.: US 10,815,748 B1
(45) Date of Patent: Oct. 27, 2020

(54) DISSOLVABLE METAL MATRIX COMPOSITES

(71) Applicants: Jonathan Meeks, Sparks, NV (US); Henry S. Meeks, Reno, NV (US)

(72) Inventors: Jonathan Meeks, Sparks, NV (US); Henry S. Meeks, Reno, NV (US)

( * ) Notice: Subject to any disclaimer, the term of this patent is extended or adjusted under 35 U.S.C. 154(b) by 0 days.

(21) Appl. No.: 15/985,685

(22) Filed: May 21, 2018

Related U.S. Application Data

(60) Provisional application No. 62/508,980, filed on May 19, 2017.

(51) Int. Cl.

| | |
|---|---|
| ***C22C 21/06*** | (2006.01) |
| ***C22C 23/02*** | (2006.01) |
| ***E21B 33/12*** | (2006.01) |
| ***B22F 3/02*** | (2006.01) |
| *E21B 43/26* | (2006.01) |
| *B22F 3/12* | (2006.01) |
| *B22F 5/00* | (2006.01) |

(52) U.S. Cl.
CPC ..... *E21B 33/12* (2013.01); *B22F 3/02* (2013.01); *B22F 3/12* (2013.01); *B22F 2005/002* (2013.01); *B22F 2301/052* (2013.01); *B22F 2301/058* (2013.01); *B22F 2301/35* (2013.01); *B22F 2998/00* (2013.01); *C22C 21/06* (2013.01); *C22C 23/02* (2013.01); *E21B 43/26* (2013.01)

(58) Field of Classification Search
None
See application file for complete search history.

(56) References Cited

U.S. PATENT DOCUMENTS

| | | | | |
|---|---|---|---|---|
| 5,032,352 | A | 7/1991 | Meeks et al. | |
| 5,980,602 | A | 11/1999 | Carden | |
| 6,372,346 | B1 | 4/2002 | Toth | |
| 8,211,247 | B2 | 7/2012 | Marya et al. | |
| 8,573,295 | B2 | 11/2013 | Johnson et al. | |
| 9,702,029 | B2 | 7/2017 | Frip et al. | |
| 9,757,796 | B2 | 9/2017 | Sherman et al. | |
| 2011/0135953 | A1* | 6/2011 | Xu | B22F 1/02 428/548 |
| 2013/0000985 | A1* | 1/2013 | Agrawal | E21B 41/00 175/87 |
| 2013/0022832 | A1* | 1/2013 | Guest | E21B 33/1208 428/610 |
| 2013/0047785 | A1* | 2/2013 | Xu | C22C 23/04 75/232 |

(Continued)

OTHER PUBLICATIONS

Extended Reach Laterals, Halliburton Completion Tools, H011789, Halliburton, Apr. 2016 (2 pp.).

(Continued)

*Primary Examiner* — Xiaobei Wang
(74) *Attorney, Agent, or Firm* — Holland & Hart, LLP

(57) ABSTRACT

A unitary body includes magnesium and aluminum and at least one of iron, tungsten, nickel, or titanium and has a dissolution rate of at least 5 mg/(cm$^2$·hr). The magnesium and aluminum and/or the iron, tungsten, nickel, and/or titanium can be present in discrete solid regions. The unitary body can include multiple sections having different compositions and different dissolution rates. The unitary body can be formed using solid-state powder metallurgy processes.

31 Claims, 2 Drawing Sheets

(56) References Cited

U.S. PATENT DOCUMENTS

| | | | | |
|---|---|---|---|---|
| 2014/0262327 | A1* | 9/2014 | Xu | B22F 5/003 166/376 |
| 2015/0240337 | A1* | 8/2015 | Sherman | C22C 1/03 420/408 |
| 2015/0259263 | A1* | 9/2015 | Sherman | C06B 45/30 149/6 |
| 2015/0285026 | A1 | 10/2015 | Frazier | |
| 2016/0201435 | A1 | 7/2016 | Frip et al. | |
| 2016/0265094 | A1* | 9/2016 | Xu | B22F 1/0003 |
| 2017/0165745 | A1* | 6/2017 | Salinas | B22D 18/06 |
| 2019/0054523 | A1* | 2/2019 | Wolf | B22D 23/06 |

OTHER PUBLICATIONS

Illusion Frac Plug, Halliburton Completion Tools, H011251, Halliburton, Apr. 2016 (2 pp.).
TervAlloy FW, Data Sheet, Part No. FW092917, Terves, Inc., 2016 (1p.).
TervAlloy FW+, Data Sheet, Part No. TAFW+092917, Terves, Inc., 2017 (1 p.).
TervAlloy HD, Data Sheet, Terves Inc., Jun 2017, (1 p.).
TervAlloy HT, Data Sheet, Part No. TAHT011618, Terves, Inc., PDF created on Jan. 16, 2018 (see "Date Information" section below for more information).
TervAlloy TAx-50E, Data Sheet, Part No. TA50082817, Terves, Inc., 2017 (1 p.).
TervAlloy TAx-100E, Data Sheet, Part No. TA100092817, Terves, Inc., 2017 (1 p.).
Walton, Z. et al., Dissolvable Plastic in Downhole Hydraulic Fracturing Applications, Offshore Technology Conference, May 2-5, 2016 (10 pp.).

* cited by examiner

DISSOLVABLE METAL MATRIX COMPOSITES

BACKGROUND OF SOME ASPECTS OF THIS SPECIFICATION

Hydraulic fracturing has become one of the most effective and economical methods for increasing hydrocarbon production from unconventional reservoirs such as shale formations. Hydraulic fracturing of horizontal wellbores in tight formations requires a method to isolate previously fractured zones and to direct the flow to the next fracture stage.

The two most common approaches to multi-stage hydraulic fracturing are the sliding sleeve approach and the plug-and-perf approach. In the sliding sleeve approach, differently sized frac balls land on a baffle seat in the sliding sleeve. The ball opens the sliding sleeves for fracturing the target zone and isolates the lower zones of the wellbore. In the plug-and-perf approach, frac plugs with a matching frac ball are used to isolate the lower zones of the wellbore, and perforation charges are used to open the next zone for fracturing.

In either approach, the frac ball or the frac plug must be removed after the target zone has been successfully fractured. Conventional frac balls and frac plugs are made of materials that are difficult to remove or break apart into difficult to process chunks. It would be desirable to develop a material that is sufficiently strong and robust to function as an oilfield tool and readily dissolve without experiencing at least some of the problems of conventional materials.

SUMMARY OF SOME ASPECTS OF THIS SPECIFICATION

Various embodiments of a unitary body are disclosed. The unitary body is made of a dissolvable metal matrix composite material and can be used in any application where the ability to dissolve is a useful property. In some embodiments, the unitary body can be used to make oilfield tools, especially frac balls, frac plugs, and the like.

The unitary body can have any suitable composition. In some embodiments, the unitary body includes a metal matrix material and a corrosion activator material. The metal matrix material forms most of the metal content of the unitary body. The corrosion activator is present in smaller amounts to facilitate rapid corrosion of the unitary body when exposed to an electrolyte solution such as a saline solution.

In some embodiments, the unitary body includes magnesium and aluminum in an amount that is at least approximately 70 wt % of the unitary body. The unitary body also includes at least one of iron, tungsten, nickel, or titanium in an amount that is no more than approximately 30 wt % of the unitary body.

In some embodiments, the unitary body has a uniform composition and/or uniform dissolution rate. In other embodiments, the unitary body has a non-uniform composition and/or non-uniform dissolution rate. For example, the unitary body can be made of two or more sections of material having different compositions and dissolution rates.

The unitary body can be made using any suitable process. In some embodiments, the unitary body can be made using a solid-state consolidation process where the metal powder does not melt as part of the process. The solid state consolidation process produces discrete solid regions that corresponds to the powder used to form the unitary body. A uniform, homogeneous particle mixture can be consolidated to produce a uniform, homogeneous unitary body (or section of a unitary body).

In some embodiments, the structure of the unitary body produced by solid-state powder metallurgy is different than that produced by melting (molten metallurgy) Mg or Al or Mg—Al alloy with the addition of secondary "insoluble" particles (W, Ni, Fe, Ti). The product produced by molten metallurgy is different than the ternary, quaternary, quinary (senary, septenary, octonary, nonary, denary, etc.) powder metallurgy unitary body. In some embodiments, the unitary body can be formed of at least 3, 4, 5, 6 or more separate powder materials.

In general, it is difficult to uniformly disperse and maintain secondary particles of any type within a melt, especially ones like tungsten that have a much higher density than the other materials such as magnesium and aluminum. Segregation within the melt due to the large density differences is common and leads to microstructural non-uniformity and non-uniform corrosion performance. In contrast, it is relatively easy to achieve and maintain uniformity using a powder metallurgy blending approach, especially when coupled with solid-state densification.

The unitary body can provide a number of advantages. One advantage is that it can dissolve uniformly into small particles that correspond to the size of the original particles used to make the unitary body. This provides a significant advantage in comparison to conventional dissolvable materials that often dissolve into larger chunks that are problematic from a processing standpoint.

The term "elemental" is used to refer to a composition of an element that is at least 99 wt % of the specified element. Therefore, a reference to "elemental magnesium" means a composition comprising at least 99 wt % magnesium, or a reference to "elemental aluminum" means a composition comprising at least 99 wt % aluminum.

There are other novel features and advantages that will become apparent as this specification proceeds. The summary is therefore provided to introduce a selection of concepts in a simplified form that are further described below in the detailed description; and the summary and the background are not intended to identify key concepts or essential aspects of the disclosed subject matter, nor should they be used to constrict or limit the scope of the claims. For example, the scope of the claims should not be limited based on whether the recited subject matter includes any or all aspects noted in the summary and/or addresses any of the issues noted in the background.

BRIEF DESCRIPTION OF THE DRAWINGS

The preferred and other embodiments are disclosed in association with the accompanying drawings in which.

DETAILED DESCRIPTION

Figure 1:
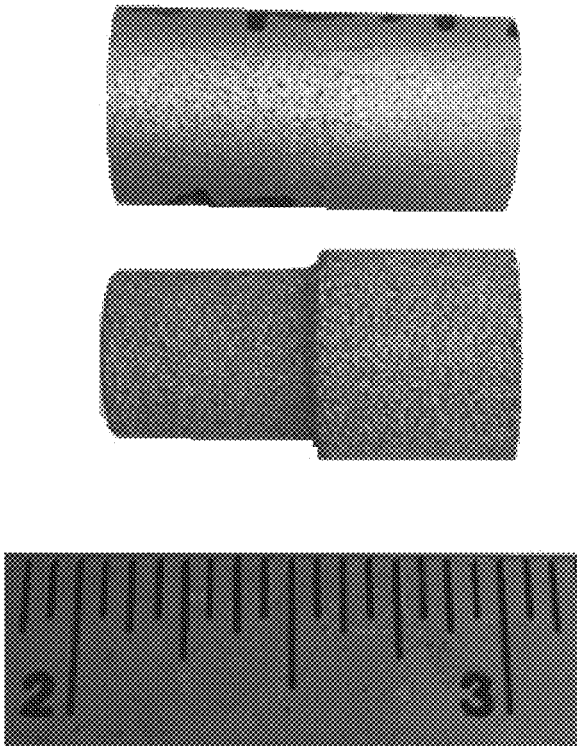
FIG. 1 shows photographs of a cylindrical embodiment of a unitary body having two sections with different dissolution rates before being placed in saline solution (top image) and after being placed in saline solution for four hours (middle image).

The unitary body can have any suitable composition. At a high level, the unitary body can include any combination of two or more metals that are capable of producing galvanic corrosion. A list of such metals can be found in the '604 patent, which is referenced at the end of the description. The following is a description of various embodiments of the unitary body where the metal matrix material is made up primarily of magnesium and/or aluminum.

In general, the unitary body includes a (a) metal matrix material comprising magnesium and/or aluminum and (b) a corrosion activator material comprising at least one of iron, tungsten, nickel, or titanium. In some embodiments, the total of magnesium and aluminum is at least approximately 70 wt % of the unitary body, at least approximately 75 wt % of the unitary body, or at least approximately 80 wt % of the unitary body. The percentages given for the total of the magnesium and aluminum in the unitary body also apply to the amount of the metal matrix material in the unitary body—e.g., the amount of metal matrix material can be at least 70 wt % of the unitary body.

In some embodiments, the unitary body includes no more than approximately 30 wt % of the total of iron, tungsten, nickel, and/or titanium, no more than approximately 25 wt % of the total of iron, tungsten, nickel, and/or titanium, or no more than approximately 20 wt % of the total of iron, tungsten, nickel, and/or titanium. The percentages given for the total of the iron, tungsten, nickel, and/or titanium in the unitary body also apply to the amount of the corrosion activator material in the unitary body—e.g., the amount of the corrosion activator material can be no more than approximately 30 wt % of the unitary body.

Metal Matrix Material

The metal matrix material can have any suitable composition. In some embodiments, the metal matrix material includes elemental magnesium, elemental aluminum, and/or a magnesium/aluminum alloy. These materials can be provided in the form of particles that are mixed and consolidated as part of a powder metallurgy process.

In some embodiments the metal matrix material is predominantly magnesium. For example, the total of the magnesium and the aluminum can be at least approximately 75 wt % magnesium, at least approximately 80 wt % magnesium, or at least approximately 85 wt % magnesium. In some embodiments, the total of the magnesium and the aluminum is no more than approximately 20 wt % aluminum, no more than approximately 15 wt % aluminum, or no more than approximately 10 wt % aluminum.

For those embodiments that include an alloy powder, any suitable alloy powder can be used. Examples of suitable alloys include magnesium alloys such as ZK-61, Mg—Al (only Mg and Al), AZ-91A-E, and the like. The alloy can be produced by chemical vapor deposition, cast ingot and grinding, gas atomizing, or any other suitable method.

Corrosion Activator Material

It should be appreciated that any suitable corrosion activator material can be used in the unitary body. Examples of suitable corrosion activator materials include, in order of decreasing activity, iron, tungsten, nickel, and titanium. Iron is preferred because of its higher activity and because it is closer in weight to the magnesium and aluminum in the metal matrix material. The specific corrosion activator material used depends on the specific requirements of the application. If a lightweight material isn't needed, then it may be desirable to use tungsten as the corrosion activator material.

In some embodiments, another phase could be added to the unitary body to increase or alter its strength characteristics. For example, a ceramic such as silicon carbide, boron carbide, or aluminum oxide could be added to the unitary body in an amount of 3 to 30 wt % to increase the strength of the unitary body. Additional examples of ceramic materials that can be included in the unitary body can be found in the '063 application referenced at the end of the description.

Corrosion Properties

The unitary body generally dissolves by way of galvanic corrosion. Galvanic corrosion is an electrochemical process in which one metal corrodes preferentially when it is in electrical contact with one or more other metals in the presence of an electrolyte. Therefore, it should be appreciated that the unitary body can be made of any combination of two or more metals having different electronegativities that is capable of galvanic corrosion. This includes all of the metals disclosed in the '604 patent.

It should be noted that because the primary mechanism by which the unitary body dissolves is corrosion, the dissolution rates disclosed in this document can also be appropriately referred to as corrosion rates. Therefore, any reference to a dissolution rate is also considered a reference to a corrosion rate.

The unitary body can dissolve or corrode in a variety of electrolyte solutions. Examples of suitable solutions include produced well water, fracking water, brine, acids, and the like. These will act as the electrolyte and cause the corrosive reaction to occur.

The unitary body can have a uniform composition and/or uniform dissolution rate. In some embodiments, the unitary body can have a uniform dissolution rate of at least approximately 5 mg/(cm2·hr), at least approximately 20 mg/(cm2·hr), at least approximately 75 mg/(cm2·hr), at least approximately 150 mg/(cm2·hr), at least approximately 225 mg/(cm2·hr), at least approximately 250 mg/(cm2·hr), or at least approximately 275 mg/(cm2·hr). In some other embodiments, the unitary body can have a uniform dissolution rate of approximately 5 mg/(cm2·hr) to approximately 20 mg/(cm2·hr), approximately 20 mg/(cm2·hr) to approximately 75 mg/(cm2·hr), approximately 75 mg/(cm2·hr) to approximately 150 mg/(cm2·hr), approximately 150 mg/(cm2·hr) to approximately 225 mg/(cm2·hr), or approximately 226 mg/(cm2·hr) to approximately 300 mg/($cm^2$·hr).

The unitary body can also have a non-uniform composition and/or non-uniform dissolution rate. For example, the unitary body can include two or more sections (three, four, five sections, and so forth) having different compositions and/or different dissolution rates. Each individual section can have any one of the dissolution rates disclosed above.

In general, it is preferable for the different sections to have significantly differently dissolution rates. In some embodiments, the dissolution rate of one section is at least approximately 25% higher than that of the other section, is at least approximately 50% higher than that of another section, at least approximately 75% higher than that of another section, at least approximately 100% higher than that of another section, at least approximately 250% higher than that of another section, at least approximately 500% higher than that of another section, at least approximately 1000% higher than that of another section, or at least approximately 2000% higher than that of another section.

The dissolution rate is determined by several factors such as how the individual composite powders are formulated.

For example, in some embodiments, the alloy powders used to produce the unitary body can be formulated by a chemical vapor deposition (CVD) process, blending of elemental powders of magnesium, aluminum, tungsten, titanium, nickel and/or iron in specific proportions, a combination of two or more of the formulations, or even blending different combinations and/or percentages of reactive powders within the unitary body composite. The dissolution rate is also dependent upon the powder particle sizes, percent concentration of the "activator" element (e.g., titanium, tungsten, nickel, iron), the density of the final body and/or the different body sections.

The dissolution rate can further depend on the corrosive material (or corrosive solution or solution material) used to corrode the unitary body. For example, corrosive materials can include "produced water" from the drilled well, a brine solution containing from 0.5% to 30% by weight of a metal chloride such as potassium chloride (KCl), sodium chloride (NaCl), an acid such as hydrochloric (HCL) and in some instances even plain water (H2O). Dissolution rates can depend on the temperature of the corrosive solution with faster rates being demonstrated by higher solution temperatures (for this example room temperature to 500° F.), time of exposure to the corrosive solution (for this example several minutes to several hours), volume ratios of the unitary body to the corrosive material, physical exchange rate of the corrosive solution against the body. For this example, if a solution is stagnant and the pH is increasing the corrosive reaction will slow down. Conversely, if fresh solution is continuously being introduced to the unitary body the solution is kept active by maintaining the pH between a level of 6.5 and 13.

Examples of specific materials that can be used to form the different sections of the unitary body are provided as follows. A highly corrosive material (>250 mg/($cm^2$·hr)) may contain elemental aluminum, elemental magnesium (Mg) and/or alloyed Mg and elemental iron (Fe) in an approximately combined 85/15 weight percent ratio. A moderately corrosive material (75 to 200 mg/($cm^2$·hr)) may contain elemental magnesium (Mg) and/or alloyed Mg and nickel (Ni) in an approximately combined 90/10 weight percent ratio. A less corrosive material (10 to 50 mg/($cm^2$·hr)) may contain elemental magnesium (Mg) and/or alloyed Mg and tungsten (W) in approximately a 95/5 weight percent ratio. The dissolution rates experienced by the unitary body sections can be adjusted almost without limitation by varying the constituents in each section of the unitary body.

The individual dissolution rates of the different unitary body sections have no bearing on how or if the other unitary body sections corrode. The corrosion mechanism is a function of the individual chemistry and difference in electronegativity of the primary activator elements, for this example Mg, Al, Ni, W, Ti, and Fe). One unitary body section does not even have to corrode it can remain intact while the corrodible unitary body section is dissolved.

Unitary Body Properties

The unitary body can have any suitable physical properties. In some embodiments, the unitary body has physical properties that are sufficient to allow it to be used as an oil field tool. For example, the strength of the unitary body can be sufficient to allow it to pass through and block a wellbore in an oil field application. Table 1 shows some of the typical properties of the unitary body, especially when it is in the form of a frac ball.

TABLE 1

Typical Properties of the Unitary Body

| Properties | As-Forged | Extruded |
|---|---|---|
| Ultimate tensile strength (UTS) (ksi) | 35-45 | 43-50 |
| 0.2% Offset yield strength (ksi) | 23-26 | 36-38 |
| Ductility (%) | 2-3 | 3-4.5 |
| Density (g/cc) | 1.82-1.92 | |
| Ultimate compressive strength (ksi) | 45-60 | |
| Compressive yield strength | 23-26 | |
| Thermal conductivity (W/mK) | 120-140 | |
| Coefficient of thermal expansion | 20-21 | |

Manufacturing Process—Unitary Body Metal Matrix Composite Having Uniform Corrosion Properties The unitary body can be made using any suitable process. The following is a description of various processes that can be used to make the unitary body. It should be appreciated that various steps in the process below can be combined, omitted, and/or reordered depending on the circumstances.

Material Preparation

The first step is to select the powder particles that produce the desired composition of the unitary body. In general, the composition includes metal matrix powder particles and corrosion activator powder particles. It should be appreciated that the powder particles can be encapsulated in or coated with various compounds that enhance inter-particle bonding, structural integrity, stiffness, reduce weight, and provide other application specific properties as desired. The coating layer can be one layer or multiple layers of the same or varying materials and in varying sequences to produce application specific properties.

It should be appreciated that the powder can have a variety of physical forms. In a preferable embodiment, the powder particles are solid particles that are made entirely of the specified material. The use of solid particles produces the discrete, solid regions of the same material in the unitary body. In some other embodiments, the powder can include hollow spheres or microballoons. In yet other embodiments, the powder can include a mixture of these materials.

The amount and type of powder particles are blended together to form a homogeneous powder or particle mixture. This can be done using a variety of powder blending technologies. Examples of suitable blenders include a uniform column "V" blender, a non-uniform column "V" blender, an attrition mill, a 3-dimensional mechanical blender, a hi-energy ball mill, and the like.

Compaction

The particle mixture is compacted to form a preform or near net shape article that is approximately 50-80% of the theoretical density. This is typically done by applying high pressure to the particle mixture in a die. In some preferred embodiments, the particle mixture is compacted at room temperature using a cold isostatic pressing (CIP) process where the particle mixture is in an elastomer mold or bag.

In some other embodiments, the particle mixture can be compacted using any suitable process such as pressing in a hard die, metal injection molding (MIM), "canning," or other suitable techniques. In these embodiments, the compaction process can take place at room temperature or at an elevated temperature.

The density of the compacted particle mixture is proportional to the amount of pressure applied. The outer surface of the particle mixture experiences compressive force sufficient to bond the particles together and form a semi-solid body. The amount of pressure varies depending on the application and composition of the particle mixture. In some embodiments, the particle mixture can be compacted at pressures between 0.5-700 MPa or, preferably, 100-650 MPa.

Consolidation or Densification

The preform is consolidated to form a metal matrix composition that is 100% fully dense. This can be accomplished using any of a number of suitable processes. In some preferred processes, the preform is consolidated using a solid-state forging process where the particles do not melt in the process. By utilizing solid-state processes, the particles form distinct regions in the unitary body.

In some embodiments, dynamic forging (DF) is used to consolidate the preform. DF involves the rapid application (within seconds) of a rate-controlled high uni-axial pressure (1.24 GPa/180 ksi) on a heated forging preform (300° C.—1500° C.) via a granular pressure transmitting media (PTM). Solid-state powder densification of the preform or hermetically sealed "canned powders," occurs in a matter of seconds within a dynamic pressure field. Unlike hot isostatic pressing (HIP) which applies a uniform low-pressure gas to consolidate the powder, the DF process simultaneously applies a large axial pressure coupled with a smaller radial pressure, thus allowing both powder consolidation and in-situ hot working of the material.

Powder deformation (shear) in DF is accomplished by the naturally induced pressure differential created in the dynamic pressure field. Thus, the 60-80% dense forging preform experiences both axial compression and radial expansion, which creates a dimensionally predictable and highly beneficial, in-situ shear stress. In some embodiments, the powder is hot consolidated in a simple "pot die" to form fully dense, near-net-shape components, thus eliminating the normal die wear associated with conventional forging.

In some embodiments, the preform is heated to the lowest temperature that will permit complete densification of the skeleton structure and the matrix. This temperature can be determined through a comprehensive parametric study of temperature, pressure, dwell-time and strain-rate, for each preform. The preform can be heated by any number of conventional methods such as radiation and induction.

In a preferred embodiment, the DF process includes the following steps. Initially, the PTM is heated in any number of ways. For example, in some embodiments, the PTM is heated in a fluidized bed furnace to the desired temperature. Several types of pressure transmitting media can be used depending upon the composition and type of the particles in preform. The pot die is partially filled with the heated PTM and the preform is placed in it. Additional heated PTM is poured into the pot die to cover the preform.

The heated PTM is pressurized with a hydraulic press ram until it consolidates the preform to full density. This is done by lowering the forging ram into the pot die until it comes into contact with the heated PTM. The forging ram exerts pressure on the heated PTM, which in turn pressurizes and virtually instantaneously consolidates the near-net-shape powder preform.

The PTM can be designed so that after consolidation it can be separated from the fully dense article using a simple screening process. The now fully dense article can be sandblasted or directly placed into a heat treat quench tank. The separated PTM can be recycled back to the fluidized bed furnace.

Although the temperature of the consolidation process is dependent on the specific composition of the particle mixture, suitable temperatures are typically between 300° C. to 1500° C. Also, suitable axial pressures to fully densify the preform can be at least 200 MPa to at least 900 MPa.

Alternate Consolidation or Densification Processes

It should be appreciated that other processes can be used to consolidate the powder preform and form a metal matrix composite material. In some embodiments, the powder preform can be consolidated using any of the solid state consolidation processes disclosed in the '604 patent referenced at the end of the description. For example, the powder preform can be consolidated using the dynamic forging process disclosed in the '604 patent. In some other embodiments, the powder preform can be consolidated using any of the solid state consolidation processes disclosed in the '063 application.

The powder preform can also be consolidated using a non-solid state process—i.e., a process where at least some of the powder particles melt usually due to the temperature exceeding the melting point of the powder particles. In some embodiments, such consolidation processes include P/M forging, hot isostatic pressing (HIP), laser processing, sintering, pulse sintering, ARCAM, metal injection molding (MIM), laser-engineered net shaping (LENS), conventional forging in a mold, spark plasma sintering (SPS), rapid pressure molding, plasma or other thermal spray process, E-beam process, liquid phase sintering (with or without pressurization), vacuum hot pressing, electro-consolidation, extrusion and ECAP extrusion. In other embodiments, such consolidation processes include any of those disclosed in the '604 patent and/or the '063 application.

It should be appreciated that although non solid-state processes can be used to consolidate the powder preform, it is generally preferred to use solid-state processes because they are believed to provide or enhance the ability of the unitary body to dissolve into fine particles rather than into larger chunks of material.

Finishing

The fully dense raw stock can be machined, extruded, and/or otherwise processed to form the final unitary body. In situations where the unitary body is machined, it can be done using manual and CNC mills and lathes and taking precautions common to the machining of flammable metals such as magnesium.

Manufacturing Process—Unitary Body Metal Matrix Composite Having Varying Corrosion Properties Non-uniform unitary bodies or unitary bodies having two or more sections with different compositions and/or dissolution rates can be made using similar processes as those disclosed above for making a uniform unitary body. The main difference between the processes is that, prior to compaction, the particle mixture for each section is arranged in the correct position using an elastomeric mold, elastomeric bag, and the like. Once the particle mixtures are in place, then they can be compacted and consolidated in any of the ways described above.

In another embodiment, a unitary body having sections with extremely different dissolution rates can be made using one or more of the steps in the following procedure:

1) The chemical and physical composition of metal powders are formulated to exhibit significantly different dissolution rates based upon respective electro-negativities of the base metal and activator elements.

2) Preferentially combining and selectively locating the metal powders possessing different dissolution rates within an elastomer bag and using Cold Isostatic compaction (CIP) at 30 ksi pressure, or powder compaction in a set of hard metal dies and punches, or metal injection molding (MIM), or selective laser sintering (SLS), or sintering or other powder compaction technologies common to those familiar with the art may be used to form a less than fully dense unitary body of from 50% to 90% of the unitary body's theoretical density.

3) Heating the less than fully dense unitary body in a protective atmosphere such as nitrogen to the desired forging temperature to partially bond the individual powder particles together.

4) Placing the heated unitary body within a closed die cavity containing a heated granular pressure transmitting medium consisting of graphite, carbon, ceramic or other suitable material.

5) Using a hydraulic ram to apply a Dual Mode Dynamic Forging pressure of from 5 ksi to 150 ksi to a punch confined within the closed die which in turn transfers the hydraulic ram pressure to the granular medium and in-turn to the less than fully dense unitary body.

6) Controlling the speed at which the punch approaches and enters the die and in-turn applies the hydraulic pressure.

7) Holding the applied pressure on the heated unitary body for a time period of from 5 seconds to 5 minutes sufficient to cause the individual powder particles to deform and significantly bond together causing a unitary body densification from between 60% and 100% of the theoretical density of the.

8) Controlling the release of the hydraulic pressure and rate of decompression to 10 seconds to 5 minutes.

9) Extracting the punch.

10) Removing the now partially or fully dense unitary body from the granular pressure transmitting medium.

Applications and Methods of Use

The unitary body can be used in a variety of applications. Examples of suitable applications include selectively blocking holes or openings, temporarily securing devices underwater (freshwater or seawater), and the like. As described above, the unitary body dissolves into fine particles instead of chunks like conventional dissolvable materials. This makes the unitary body especially suitable for use in confined areas such as pipes, well bores, and the like, where the fine particles won't plug the opening like the chunks produced by conventional materials.

One particularly suitable application for the unitary body is for making dissolvable oilfield tools such as dissolvable plugs, balls, seats, slips, cones, and the like. For example, the unitary body can be a frac ball having a uniform composition and uniform dissolution rate. The frac ball can be positioned in a given location in a wellbore to enable hydraulic fracturing of a target zone and isolate lower zones of the wellbore. When hydraulic fracturing of the target zone has been completed, the frac ball can be dissolved by exposing it to a corrosive brine solution. In some embodiments, the solution is a brine solution that is common to fracking operations.

In another example, the unitary body can be an oilfield tool having a non-uniform composition and a non-uniform dissolution rate. The tool can have an outer section that has a comparatively high dissolution rate and an inner section that has a comparatively low dissolution rate. The tool may be configured this way so that the inner section provides beneficial physical properties such as increased strength and toughness while the outer section provides a comparatively high dissolution rate. When it is time to remove the tool, the outer section dissolves rapidly to allow the tool to pass through and quickly open the hole it was blocking. The inner section of the tool continues to dissolve slowly until it is gone.

It should be appreciated that the unitary body can be used in other applications besides those involving oilfields. For example, the unitary body can be used to provide dissolvable components used in 3D printing. The dissolvable components can be included in the printed article and then removed later to produce the final article. There are numerous other examples of situations where the unitary body can be used as a sacrificial or temporary component as part of the process of building or producing a larger structure or component.

Examples

The following examples are provided to further illustrate the disclosed subject matter. They should not be used to constrict or limit the scope of the claims in any way.

Example 1—Dissolution Rate Measurement

The dissolution rates given in this document are determined using the following method.

1. Weigh the unitary body to determine the initial weight (Mi) of the unitary body. Measure and/or calculate the initial surface area (Ai) of the unitary body.
2. Heat a saline solution bath (3 vol % KCl) to 200° F.
3. Immerse the unitary body in the bath for 4 hours (while holding the temperature of the bath at 94° C. (200° F.)).
4. Remove the corroded unitary body from the bath and allow it to dry.
6. Weigh the unitary body to determine the final weight (Mf) of the unitary body. Measure and/or calculate the final surface area (Af) of the unitary body.
7. Calculate the corrosion or dissolution rate using the following equation:

$$\text{Rate}=(Mi-Mf)/(((Ai-Af)/2)*(\text{Time in bath}))$$

Example 2—Manufacture of a Unitary Bodies Having a Uniform Dissolution Rate

A number of samples of a unitary body are made having the compositions shown in Table 2-Table 7 below. The samples have a uniform composition and uniform dissolution rate. The samples are made into the shape of a ball or sphere.

TABLE 2

Compositions of unitary body samples

| | Samples | | | | | |
|---|---|---|---|---|---|---|
| Material | 1 wt % (μm) | 2 wt % (μm) | 3 wt % (μm) | 4 wt % (μm) | 5 wt % (μm) | 6 wt % (μm) |
| Metal matrix[1] | | | | | | |
| Mg particles[2] | 90.16-91.08 | — | — | 89.24-90.16 | — | — |
| Al particles[2] | 7.84-7.92 | — | — | 7.76-7.84 | — | — |

TABLE 2-continued

| Compositions of unitary body samples | | | | | | |
|---|---|---|---|---|---|---|
| | Samples | | | | | |
| Material | 1 wt % (μm) | 2 wt % (μm) | 3 wt % (μm) | 4 wt % (μm) | 5 wt % (μm) | 6 wt % (μm) |
| M92A8 alloy[3] | — | 98-99 | — | — | 97-98 | — |
| AZ91 alloy[4] | — | — | 98-99 | — | — | 97-98 |
| Corrosion activator[5] | | | | | | |
| Fe particles[2] | — | — | — | — | — | — |
| W particles[2] | 1-2 | 1-2 | 1-2 | — | — | — |
| Ni particles[2] | — | — | — | 2-3 | 2-3 | 2-3 |
| Dissolution rate (mg/(cm$^2$ · hr) | 5-20 | 5-20 | 5-20 | 5-20 | 5-20 | 5-20 |

[1]All metal matrix particle are no larger than 150 μm (−100 mesh).

[2]Elemental particles

[3]M92A8 = particles of an alloy that is 92 wt % Mg and 8 wt % Al.

[4]AZ91 = particles of an alloy that is 90 wt % Mg, 9 wt % Al, and 1 wt % zinc.

[5]All corrosion activator particles are no larger than 53 μm (−270 mesh).

TABLE 3

| Compositions of unitary body samples | | | | | | |
|---|---|---|---|---|---|---|
| | Samples | | | | | |
| Material | 7 wt % (μm) | 8 wt % (μm) | 9 wt % (μm) | 10 wt % (μm) | 11 wt % (μm) | 12 wt % (μm) |
| Metal matrix[1] | | | | | | |
| Mg particles[2] | 87.40-88.32 | — | — | 85.56-86.48 | — | — |
| Al particles[2] | 7.60-7.68 | — | — | 7.44-7.52 | — | — |
| M92A8 alloy[3] | — | 95-96 | — | — | 93-94 | — |
| AZ91 alloy[4] | — | — | 95-96 | — | — | 93-94 |
| Corrosion activator[5] | | | | | | |
| Fe particles[2] | — | — | — | — | — | — |
| W particles[2] | 4-5 | 4-5 | 4-5 | — | — | — |
| Ni particles[2] | — | — | — | 6-7 | 6-7 | 6-7 |
| Dissolution rate (mg/(cm$^2$ · hr) | 21-75 | 21-75 | 21-75 | 21-75 | 21-75 | 21-75 |

[1]All metal matrix particle are no larger than 150 μm (−100 mesh).

[2]Elemental particles

[3]M92A8 = particles of an alloy that is 92 wt % Mg and 8 wt % Al.

[4]AZ91 = particles of an alloy that is 90 wt % Mg, 9 wt % Al, and 1 wt % zinc.

[5]All corrosion activator particles are no larger than 53 μm (−270 mesh).

TABLE 4

| Compositions of unitary body samples | | | | | | |
|---|---|---|---|---|---|---|
| | Samples | | | | | |
| Material | 13 wt % (μm) | 14 wt % (μm) | 15 wt % (μm) | 16 wt % (μm) | 17 wt % (μm) | 18 wt % (μm) |
| Metal matrix[1] | | | | | | |
| Mg particles[2] | 85.56-86.48 | — | — | 84.64-85.56 | — | — |
| Al particles[2] | 7.44-7.52 | — | — | 7.36-7.44 | — | — |
| M92A8 alloy[3] | — | 93-94 | — | — | 92-93 | — |
| AZ91 alloy[4] | — | — | 93-94 | — | — | 92-93 |
| Corrosion activator[5] | | | | | | |
| Fe particles[2] | — | — | — | — | — | — |
| W particles[2] | 6-7 | 6-7 | 6-7 | — | — | — |

TABLE 4-continued

| Compositions of unitary body samples | | | | | | |
|---|---|---|---|---|---|---|
| | Samples | | | | | |
| Material | 13 wt % (μm) | 14 wt % (μm) | 15 wt % (μm) | 16 wt % (μm) | 17 wt % (μm) | 18 wt % (μm) |
| Ni particles[2] | — | — | — | 7-8 | 7-8 | 7-8 |
| Dissolution rate (mg/(cm$^2$ · hr) | 76-150 | 76-150 | 76-150 | 76-150 | 76-150 | 76-150 |

[1]All metal matrix particle are no larger than 150 μm (−100 mesh).

[2]Elemental particles

[3]M92A8 = particles of an alloy that is 92 wt % Mg and 8 wt % Al.

[4]AZ91 = particles of an alloy that is 90 wt % Mg, 9 wt % Al, and 1 wt % zinc.

[5]All corrosion activator particles are no larger than 53 μm (−270 mesh).

TABLE 5

| Compositions of unitary body samples | | | | | | |
|---|---|---|---|---|---|---|
| | Samples | | | | | |
| Material | 19 wt % (μm) | 20 wt % (μm) | 21 wt % (μm) | 22 wt % (μm) | 23 wt % (μm) | 24 wt % (μm) |
| Metal matrix[1] | | | | | | |
| Mg particles[2] | 84.64-85.56 | — | — | 84.64 | — | — |
| Al particles[2] | 7.36-7.44 | — | — | 7.36 | — | — |
| M92A8 alloy[3] | — | 92-93 | — | — | 92 | — |
| AZ91 alloy[4] | — | — | 92-93 | — | — | 92 |
| Corrosion activator[5] | | | | | | |
| Fe particles[2] | — | — | — | — | — | — |
| W particles[2] | 7-8 | 7-8 | 7-8 | — | — | — |
| Ni particles[2] | — | — | — | 8 | 8 | 8 |
| Dissolution rate (mg/(cm$^2$ · hr) | 151-225 | 151-225 | 151-225 | 151-225 | 151-225 | 151-225 |

[1]All metal matrix particle are no larger than 150 μm (−100 mesh).

[2]Elemental particles

[3]M92A8 = particles of an alloy that is 92 wt % Mg and 8 wt % Al.

[4]AZ91 = particles of an alloy that is 90 wt % Mg, 9 wt % Al, and 1 wt % zinc.

[5]All corrosion activator particles are no larger than 53 μm (−270 mesh).

TABLE 6

| Compositions of unitary body samples | | | | | | |
|---|---|---|---|---|---|---|
| | Samples | | | | | |
| Material | 25 wt % (μm) | 26 wt % (μm) | 27 wt % (μm) | 28 wt % (μm) | 29 wt % (μm) | 30 wt % (μm) |
| Metal matrix[1] | | | | | | |
| Mg particles[2] | 78.2-80.96 | — | — | 73.6-78.2 | — | — |
| Al particles[2] | 6.8-7.04 | — | — | 6.4-6.8 | — | — |
| M92A8 alloy[3] | — | 88-95 | — | — | 80-85 | — |
| AZ91 alloy[4] | — | — | 88-95 | — | — | 80-85 |
| Corrosion activator[5] | | | | | | |
| Fe particles[2] | 12-15 | 12-15 | 12-15 | 15-20 | 15-20 | 15-20 |
| W particles[2] | — | — | — | — | — | — |
| Ni particles[2] | — | — | — | — | — | — |
| Dissolution rate (mg/(cm$^2$ · hr) | >225 | >225 | >225 | >275 | >275 | >275 |

[1]All metal matrix particle are no larger than 150 μm (−100 mesh).

[2]Elemental particles

[3]M92A8 = particles of an alloy that is 92 wt % Mg and 8 wt % Al.

[4]AZ91 = particles of an alloy that is 90 wt % Mg, 9 wt % Al, and 1 wt % zinc.

[5]All corrosion activator particles are no larger than 53 μm (−270 mesh).

TABLE 7

Compositions of unitary body samples

| Material | Samples 31 wt % (μm) | Samples 32 wt % (μm) |
|---|---|---|
| Metal matrix[1] | | |
| Mg particles[2] | 43.7 | 39.1 |
| Al particles[2] | 3.8 | 3.4 |
| M92A8 alloy[3] | 47.5 | 42.5 |
| AZ91 alloy[4] | — | — |
| Corrosion activator[5] | | |
| Fe particles[2] | 15 | 15 |
| W particles[2] | — | — |
| Ni particles[2] | — | — |
| Dissolution rate (mg/(cm$^2$ · hr) | 150 | 268 |

[1]All metal matrix particle are no larger than 150 μm (−100 mesh).
[2]Elemental particles
[3]M92A8 = particles of an alloy that is 92 wt % Mg and 8 wt % Al.
[4]AZ91 = particles of an alloy that is 90 wt % Mg, 9 wt % Al, and 1 wt % zinc.
[5]All corrosion activator particles are no larger than 53 μm (−270 mesh).

The samples are made using the following process. First, the amount and size of powder specified for each sample is blended until it is uniform. Second, the blended powder is compacted at room temperature using a cold isostatic pressing process to form a preform or near net shape article that is approximately 80% of the theoretical density.

Third, the preform is consolidated or densified using a dual mode dynamic forging (DMDF) process at an elevated temperature to form a metal matrix composite that is approximately 100% of the theoretical density. The DMDF process uses the lowest temperature that permits complete densification of the preform and is below the point at which the preform will melt. Depending on the composition of the powder particles, this temperature can be approximately 300° C. to approximately 1500° C.

A granular pressure transmitting media (PTM) is heated in a fluidized bed furnace to the process temperature. A pot die is partially filled with the heated PTM. The preform is placed in the partially filled pot die by a robot. Additional PTM is poured into the pot die unit it covers the powder preform.

A forging ram is lowered into the pot die where it contacts the heated PTM. The forging ram exerts pressure on the PTM, which in turn pressurizes and virtually instantaneously consolidates the preform. The DMDF process simultaneously applies a large axial pressure (1.24 GPa/180 ksi) coupled with a smaller radial pressure that both consolidates and in-situ hot works the powder particles.

The PTM is separated from the consolidated metal matrix composite material using a screen. The fully dense consolidated material is sandblasted or directly placed into a heat treat quench tank. The separated PTM is recycled back through the fluidized bed furnace. The fully dense metal matrix composite material is machined to form frac balls.

Example 3—Manufacture of a Unitary Body Having Sections with Different Dissolution Rates A number of samples of a unitary body having sections with different dissolution rates are made using the following process. The samples are made using the same process described in Example 2 except the different sections of the unitary body are made using different samples to produce the different dissolution rates. The different sections can be kept separate from each other during compaction and consolidation using one or more elastomeric molds or bags. For example, an elastomer bag is filled with the desired powder composition and in the proper sequence so as to have the various dissolution rate powders located at the selected and pre-determined locations.

Figure 2:
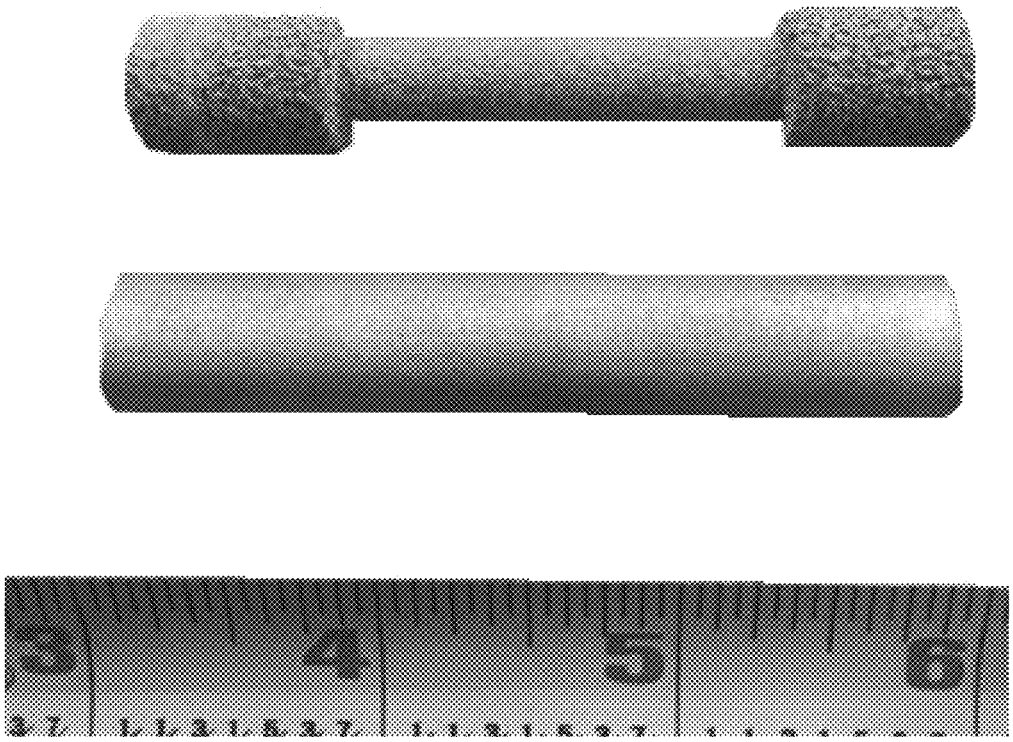
FIG. 2 shows photographs of another cylindrical embodiment of a unitary body having two different sections with different dissolution rates before being placed in saline solution (middle image) and after being placed in saline solution for four hours (top image).
Figure 3:
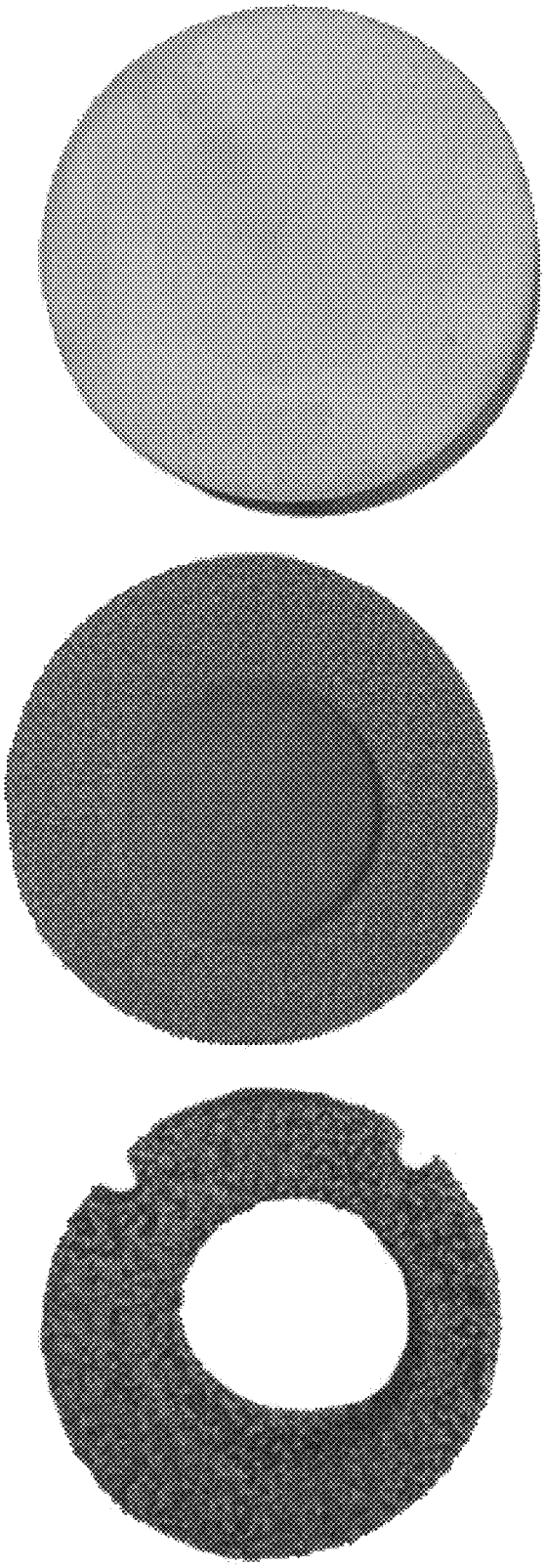
FIG. 3 shows photographs of a disk shaped embodiment of a unitary body having two different sections with different dissolution rates before being placed in saline solution (top image), after being placed in saline solution for 45 minutes (middle image) and four hours (bottom image).

FIGS. 1-3 show examples of unitary bodies having different sections with different dissolution rates. The shapes shown in FIGS. 1-2 are each prepared by filling a cylindrical elastomer bag with the lower dissolution rate powder—i.e., the powder having the composition of Sample 31 in Table 7. The higher dissolution rate powder is added—i.e., the powder having the composition of Sample 32 in Table 7. (If desired additional dissolution rate powders can be added in similar way.) The elastomer bag is then sealed and consolidated using a solid-state consolidation process.

The shape shown in FIG. 3 is prepared by fitting a cylindrical elastomer bag with a thin walled tube. The tube extends down the middle of the bag and is fixed in place by fixtures. The lower dissolution rate powder (Sample 31) is then added to the elastomer bag in the outer volume section created between the elastomer bag and outside diameter of the tube. The higher dissolution rate powder (Sample 32) is added to the inside volume created by the tube.

The tube is carefully removed to not disturb the boundary layer between the two different dissolution rate powders. Caution should be taken not to have the two different dissolution rates powders cross-pollinate during this step. During this procedure some minor interlocking of different dissolution rate powder particles is acceptable and desirable. The elastomer bag is then sealed and cold consolidated using a solid-state consolidation process.

Each unitary body is exposed to saline solution in the manner disclosed in Example 1. FIGS. 1-3 show the unitary body before and after it is exposed to a saline solution for four hours. FIG. 3 also shows the unitary body after it has been exposed to the saline solution for 45 minutes.

Illustrative Embodiments

Reference is made in the following to several illustrative embodiments of the disclosed subject matter. The following embodiments illustrate only a few selected embodiments that may include one or more of the various features, characteristics, and advantages of the disclosed subject matter. Accordingly, the following embodiments should not be considered as being comprehensive of all possible embodiments.

In one embodiment, a unitary body includes any single feature or any combination of features described in this document. Each embodiment described below can be modified to add or remove any feature, property, or aspect disclosed in this document to produce an additional embodiment.

In another embodiment, a unitary body comprises a first or preferential section or zone that has one dissolution rate and a second section or zone that has another dissolution rate that is lower than the dissolution rate of the first section.

In another embodiment, a unitary body comprises a multiplicity of sections or zones each having its own specific rate of corrosion relative to the other sections or zones contained in the unitary body. The second section may not corrode at all or only an insubstantial amount when exposed to a corrosive solution.

The unitary body can include a core section surrounded by a cylindrical shell section. In some embodiments, the core section can be the first section and the cylindrical section can be the second section—e.g., the core corrodes away when exposed to a corrosive solution to leave a sleeve of the second section. This may be useful in the context of a well bore drilled to extract oil, gas, or other valuable hydrocarbons.

In other embodiments, the core section can be the second section and the cylindrical section can be the first section—e.g., the shell corrodes away when exposed to a corrosive solution to quickly dislodge and open a blocked passageway such as a pipe or drill hole. This may be useful in the context of a well bore drilled to extract oil, gas, or other valuable hydrocarbons.

In another embodiment, a method for using the unitary body can comprise lowering the unitary body into a well bore (e.g., a hydrocarbon recovery well such as an oil well, gas well, or the like) to temporarily block the well bore in one fashion or another and exposing the unitary body to a corrosive solution that corrodes away the first or preferential section of the unitary body to, optionally, open the well bore.

In another embodiment, a method for using the unitary body can comprise a multiplicity of sections or zones, randomly placed or in a specific sequence based upon known dissolution rates, each having its own specific rate of corrosion relative to the other sections or zones so as to provide a preferential degradation of the unitary body into a well bore (e.g., a hydrocarbon recovery well such as an oil well, gas well, or the like) to temporarily block the well bore in one fashion or another.

In another embodiment, a unitary body comprises: magnesium and aluminum, the total of the magnesium and the aluminum being at least approximately 70 wt % of the unitary body; and at least one of iron, tungsten, nickel, or titanium, the total of the iron, the tungsten, the nickel, and/or the titanium being no more than approximately 30 wt % of the unitary body; wherein the iron, the tungsten, the nickel, and/or the titanium is present in discrete solid regions; and wherein the unitary body has a dissolution rate of at least 5 mg/(cm$^2$·hr).

In some embodiments, the total of the magnesium and the aluminum can be at least approximately 75 wt % magnesium. At least a majority of the total of the magnesium and the aluminum can be present as discrete solid regions. At least a majority of the total of the magnesium and the aluminum can be present as discrete solid regions of elemental magnesium, elemental aluminum, and/or an alloy comprising magnesium and aluminum.

In some embodiments, the unitary body comprises iron. At least a majority of the total of the iron, the tungsten, the nickel, and/or the titanium can be present as discrete solid regions. At least a majority of the total of the iron, the tungsten, the nickel, and/or the titanium can be present as discrete solid regions of elemental iron, elemental tungsten, elemental nickel, and/or elemental titanium.

In some embodiments, the unitary body can consist essentially of the magnesium, the aluminum, and the at least one of iron, tungsten, nickel, or titanium. The unitary body can comprise a metal matrix material consisting essentially of the total of the magnesium and the aluminum and a corrosion activator material consisting essentially of the at least one of iron, tungsten, nickel, and/or titanium. The composition of the unitary body can be homogeneous or non-homogeneous.

In some embodiments, the unitary body has an at least approximately uniform dissolution rate throughout. In other embodiments, the unitary body has a non-uniform dissolution rate that varies in different sections or zones that have different compositions. The unitary body can comprise a first section having a first dissolution rate and a second section having a second dissolution rate, wherein the first dissolution rate is higher than the second dissolution rate. The unitary body can have a dissolution rate of at least 150 mg/(cm$^2$·hr).

In some embodiments, the unitary body is made using a solid-state compaction process where the metals in the unitary body are not heated above their melting points. The unitary body can be a solid state densified unitary body.

In another embodiment, the unitary body comprises: at least approximately 80 wt % of metal matrix material, the metal matrix material comprising: approximately 85 wt % to approximately 95 wt % magnesium and approximately 5 wt % to approximately 15 wt % aluminum; approximately 1 wt % to 20 wt % of corrosion activator material, the corrosion activator material comprising the iron, the tungsten, the nickel, and/or the titanium; wherein the magnesium and the aluminum are present as discrete solid regions of elemental magnesium, elemental aluminum, and/or an alloy comprising magnesium and aluminum; wherein the iron, tungsten, nickel, and/or titanium are present as discrete solid regions of elemental iron, elemental tungsten, elemental nickel, and/or elemental titanium.

In some embodiments, the unitary body comprises a first section having a first dissolution rate and a second section having a second dissolution rate, wherein the first dissolution rate is higher than the second dissolution rate. A weight ratio of the metal matrix to the corrosion activator material can be lower for the first section than for the second section. The discrete solid regions of the corrosion activator material can be at least 25% smaller than the discrete solid regions of the metal matrix material.

In another embodiment, a unitary body comprises: magnesium and aluminum, the total of the magnesium and the aluminum being at least approximately 70 wt % of the unitary body; and at least one of iron, nickel, or titanium, the total of the iron, the nickel, and/or the titanium being no more than approximately 30 wt % of the unitary body; wherein the unitary body has a dissolution rate of at least 5 mg/(cm$^2$·hr).

In another embodiment, a unitary body comprises: a first section comprising: (a) magnesium and aluminum, the total of the magnesium and the aluminum being at least approximately 70 wt % of the first section of the unitary body; and (b) at least one of iron, tungsten, nickel, or titanium; and a second section comprising: (c) magnesium and aluminum, the total of the magnesium and the aluminum being at least approximately 70 wt % of the second section of the unitary body; and (d) at least one of iron, tungsten, nickel, or titanium; wherein the total of the magnesium and the aluminum in the first section is lower than the total of the magnesium and aluminum in the second section; and wherein the first section has a higher dissolution rate than the second section.

In another embodiment, a method for making a unitary body comprises: mixing (a) elemental magnesium particles, elemental aluminum particles, and/or alloy particles comprising magnesium and aluminum and (b) elemental iron particles, elemental tungsten particles, elemental nickel particles, and/or elemental titanium particles to form a particle mixture; consolidating the particle mixture at a temperature below the melting point of the particles in the particle mixture to form a unitary body.

In some embodiments, the particle mixture is a first particle mixture and the method comprises: mixing (a) elemental magnesium particles, elemental aluminum particles, and/or alloy particles comprising magnesium and aluminum and (b) elemental iron particles, elemental tungsten particles, elemental nickel particles, and/or elemental titanium particles to form a second particle mixture having a different composition than the first particle mixture; consolidating the first particle mixture and the second particle mixture at a temperature below the melting point of the particles in the first particle mixture and the second particle mixture to form the unitary body; wherein the first particle mixture forms a first section of the unitary body and the second particle mixture forms a second section of the unitary body; and wherein the first section has a higher dissolution rate than the second section.

General Terminology and Interpretative Conventions

Any methods described in the claims or specification should not be interpreted to require the steps to be performed in a specific order unless stated otherwise. Also, the methods should be interpreted to provide support to perform the recited steps in any order unless stated otherwise.

Articles such as "the," "a," and "an" can connote the singular or plural. Also, the word "or" when used without a preceding "either" (or other similar language indicating that "or" is unequivocally meant to be exclusive—e.g., only one of x or y, etc.) shall be interpreted to be inclusive (e.g., "x or y" means one or both x or y).

The term "and/or" shall also be interpreted to be inclusive (e.g., "x and/or y" means one or both x or y). In situations where "and/or" or "or" are used as a conjunction for a group of three or more items, the group should be interpreted to include one item alone, all the items together, or any combination or number of the items.

The terms have, having, include, and including should be interpreted to be synonymous with the terms comprise and comprising. The use of these terms should also be understood as disclosing and providing support for narrower alternative embodiments where these terms are replaced by "consisting" or "consisting essentially of."

Unless otherwise indicated, all numbers or expressions, such as those expressing dimensions, physical characteristics, and the like, used in the specification (other than the claims) are understood to be modified in all instances by the term "approximately." At the very least, and not as an attempt to limit the application of the doctrine of equivalents to the claims, each numerical parameter recited in the specification or claims which is modified by the term "approximately" should be construed in light of the number of recited significant digits and by applying ordinary rounding techniques.

All disclosed ranges are to be understood to encompass and provide support for claims that recite any and all subranges or any and all individual values subsumed by each range. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

All disclosed numerical values are to be understood as being variable from 0-100% in either direction and thus provide support for claims that recite such values or any and all ranges or subranges that can be formed by such values. For example, a stated numerical value of 8 should be understood to vary from 0 to 16 (100% in either direction) and provide support for claims that recite the range itself (e.g., 0 to 16), any subrange within the range (e.g., 2 to 12.5) or any individual value within that range (e.g., 15.2).

The terms recited in the claims should be given their ordinary and customary meaning as determined by reference to relevant entries in widely used general dictionaries and/or relevant technical dictionaries, commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used in a manner that is more expansive than its ordinary and customary meaning, the term should be given its ordinary and customary meaning plus the additional expansive meaning, or (b) if a term has been explicitly defined to have a different meaning by reciting the term followed by the phrase "as used in this document shall mean" or similar language (e.g., "this term means," "this term is defined as," "for the purposes of this disclosure this term shall mean," etc.). References to specific examples, use of "i.e.," use of the word "invention," etc., are not meant to invoke exception (b) or otherwise restrict the scope of the recited claim terms. Other than situations where exception (b) applies, nothing contained in this document should be considered a disclaimer or disavowal of claim scope.

The subject matter recited in the claims is not coextensive with and should not be interpreted to be coextensive with any embodiment, feature, or combination of features described or illustrated in this document. This is true even if only a single embodiment of the feature or combination of features is illustrated and described in this document.

Drawing Related Terminology and Interpretative Conventions

The drawings shall be interpreted as illustrating one or more embodiments that are drawn to scale and/or one or more embodiments that are not drawn to scale. This means the drawings can be interpreted, for example, as showing: (a) everything drawn to scale, (b) nothing drawn to scale, or (c) one or more features drawn to scale and one or more features not drawn to scale. Accordingly, the drawings can serve to provide support to recite the sizes, proportions, and/or other dimensions of any of the illustrated features either alone or relative to each other. Furthermore, all such sizes, proportions, and/or other dimensions are to be understood as being variable from 0-100% in either direction and thus provide support for claims that recite such values or any and all ranges or subranges that can be formed by such values.

Spatial or directional terms, such as "left," "right," "front," "back," and the like, relate to the subject matter as it is shown in the drawings. However, it is to be understood that the described subject matter may assume various alternative orientations and, accordingly, such terms are not to be considered as limiting.

INCORPORATION BY REFERENCE

The entire contents of each of the documents listed below are incorporated by reference into this document. If the same term is used in both this document and one or more of the incorporated documents, then it should be interpreted to have the broadest meaning imparted by any one or combination of these sources unless the term has been explicitly defined to have a different meaning in this document. If there is an inconsistency between any of the following documents and this document, then this document shall govern. The incorporated subject matter should not be used to limit or narrow the scope of the explicitly recited or depicted subject matter.

U.S. Prov. App. No. 62/508,980, titled "Unitary Body Having Sections with Different Corrosion Rates," filed on 19 May 2017.

U.S. Pat. No. 8,535,604 (application Ser. No. 12/427,486), titled "Multifunctional High Strength Metal Composite Materials," filed on 21 Apr. 2009, issued on 17 Sep. 2013 (the '604 patent).

U.S. Pat. App. Pub. No. 2017/0160063 (application Ser. No. 15/371,762), titled "Composite Material Having an Internal Skeleton Structure," filed on 7 Dec. 2016, published on 8 Jun. 2017 (the '063 application).

The invention claimed is:

1. A unitary body comprising:

magnesium or aluminum, the total of the magnesium and the aluminum being at least approximately 70 wt % of the unitary body; and at least one of iron, tungsten, nickel, or titanium, the total of the iron, the tungsten, the nickel, and the titanium being no more than approximately 30 wt % of the unitary body;

wherein the iron, the tungsten, the nickel, and/or the titanium is present in uniformly dispersed, discrete solid regions;

wherein the unitary body comprises elemental titanium;

wherein the unitary body is formed by a solid state consolidation process; and wherein the unitary body has a dissolution rate of at least 5 mg/(cm$^2$·hr), the dissolution rate being determined by immersing the unitary body in a 3 vol % KCl aqueous solution at 200° F. for 4 hours.

2. The unitary body of claim 1 wherein the total of the magnesium and the aluminum is at least approximately 75 wt % magnesium.

3. The unitary body of claim 1 wherein at least a majority of the total of the magnesium and the aluminum are present as uniformly dispersed, discrete solid regions.

4. The unitary body of claim 1 wherein at least a majority of the total of the magnesium and the aluminum are present as uniformly dispersed, discrete solid regions of elemental magnesium, elemental aluminum, and/or an alloy comprising magnesium and aluminum.

5. The unitary body of claim 1 comprising iron.

6. The unitary body of claim 1 wherein at least a majority of the total of the iron, the tungsten, the nickel, and the titanium are present as uniformly dispersed, discrete solid regions.

7. The unitary body of claim 1 wherein at least a majority of the total of the iron, the tungsten, the nickel, and the titanium are present as uniformly dispersed, discrete solid regions of elemental iron, elemental tungsten, elemental nickel, and/or elemental titanium.

8. The unitary body of claim 1 wherein the unitary body consists essentially of the magnesium, the aluminum, the elemental titanium, and optionally at least one of iron, tungsten, nickel, or titanium.

9. The unitary body of claim 1 comprising a metal matrix material consisting essentially of the total of the magnesium and the aluminum and a corrosion activator material consisting essentially of the at least one of iron, tungsten, nickel, and/or titanium.

10. The unitary body of claim 1 wherein the composition of the unitary body is homogeneous.

11. The unitary body of claim 1 wherein the unitary body has an at least approximately uniform dissolution rate throughout.

12. The unitary body of claim 1 comprising a first section having a first dissolution rate and a second section having a second dissolution rate, wherein the first dissolution rate is higher than the second dissolution rate.

13. The unitary body of claim 1 wherein the dissolution rate is at least 150 mg/(cm$^2$·hr).

14. The unitary body of claim 1 comprising:

at least approximately 80 wt % of metal matrix material, the metal matrix material comprising:

approximately 85 wt % to approximately 95 wt % the magnesium and approximately 5 wt % to approximately 15 wt % the aluminum;

approximately 1 wt % to approximately 20 wt % of corrosion activator material, the corrosion activator material comprising the iron, the tungsten, the nickel, and/or the titanium;

wherein the magnesium and the aluminum are present as uniformly dispersed, discrete solid regions of elemental magnesium, elemental aluminum, and/or an alloy comprising magnesium and aluminum;

wherein the iron, tungsten, nickel, and/or titanium are present as uniformly dispersed, discrete solid regions of elemental iron, elemental tungsten, elemental nickel, and/or elemental titanium.

15. The unitary body of claim 14 comprising a first section having a first dissolution rate and a second section having a second dissolution rate, wherein the first dissolution rate is higher than the second dissolution rate.

16. The unitary body of claim 15 wherein a weight ratio of the metal matrix to the corrosion activator material is lower for the first section than for the second section.

17. The unitary body of claim 14 wherein the uniformly dispersed, discrete solid regions of the corrosion activator material are at least 25% smaller than the uniformly dispersed, discrete solid regions of the metal matrix material.

18. The unitary body of claim 1 wherein the solid state consolidation process includes consolidating powder particles and the solid regions correspond to a uniform, homogeneous mixture of the powder particles.

19. A unitary body comprising:

magnesium or aluminum, the total of the magnesium and the aluminum being at least approximately 70 wt % of the unitary body; and at least one of iron, nickel, or titanium, the total of the iron, the nickel, and/or the titanium being no more than approximately 30 wt % of the unitary body;

wherein the magnesium or aluminum and the at least one of iron, nickel, or titanium are uniformly dispersed in at least a section of the unitary body;

wherein the unitary body comprises elemental titanium;

wherein the unitary body is formed by a solid state consolidation process; and wherein the unitary body has a dissolution rate of at least 5 mg/(cm$^2$·hr), the dissolution rate being determined by immersing the unitary body in a 3 vol % KCl aqueous solution at 200° F. for 4 hours.

20. The unitary body of claim 19 wherein the total of the magnesium and the aluminum is at least approximately 75 wt % magnesium.

21. The unitary body of claim 19 wherein at least a majority of the total of the iron, the nickel, and/or the titanium are present as uniformly dispersed, discrete solid regions.

22. The unitary body of claim 19 wherein the unitary body consists essentially of the magnesium, the aluminum, the elemental titanium, and optionally at least one of iron, nickel, or titanium.

23. The unitary body of claim 19 wherein the composition of the unitary body is homogeneous.

24. The unitary body of claim 19 wherein the section of the unitary body has an at least approximately uniform dissolution rate throughout.

25. The unitary body of claim 19 wherein the dissolution rate is at least 150 mg/(cm2·hr).

26. A unitary body comprising:

a first section comprising:

magnesium or aluminum, the total of the magnesium and the aluminum being at least approximately 70 wt % of the first section of the unitary body; and at least one of iron, tungsten, nickel, or titanium; and a second section comprising:

magnesium or aluminum, the total of the magnesium and the aluminum being at least approximately 70 wt % of the second section of the unitary body; and at least one of iron, tungsten, nickel, or titanium;

wherein the total of the magnesium and the aluminum in the first section is lower than the total of the magnesium and aluminum in the second section;

wherein the first section has a higher dissolution rate than the second section;

wherein the iron, tungsten, nickel, and/or titanium in the first section is uniformly dispersed throughout the first section and the iron, tungsten, nickel, and/or titanium in the second section is uniformly dispersed throughout the second section;

wherein at least one of the first section or the second section comprises elemental titanium; wherein the total of the iron, the tungsten, the nickel, and the titanium is no more than approximately 30 wt % of the first section or of the second section and wherein the unitary body is formed by a solid state consolidation process.

27. The unitary body of claim 26 wherein the total of the magnesium and the aluminum in the first section or the second section is at least approximately 75 wt % magnesium.

28. The unitary body of claim 26 wherein at least one of the first section or the second section consists essentially of the magnesium, the aluminum, the elemental titanium, and optionally at least one of iron, tungsten, nickel, or titanium.

29. The unitary body of claim 28 wherein both the first section and the second section consist essentially of the magnesium, the aluminum, the elemental titanium, and optionally at least one of iron, tungsten, nickel, or titanium.

30. The unitary body of claim 26 wherein the composition of at least one of the first section or the second section is homogeneous.

31. The unitary body of claim 26 wherein at least one of the first section or the second section has a dissolution rate of at least 150 mg/($cm^2$·hr) the dissolution rate being determined by immersing the unitary body in a 3 vol % KCl aqueous solution at 200° F. for 4 hours.

* * * * *